United States Patent [19]

Edmond et al.

[11] 4,153,119

[45] May 8, 1979

[54] DIRECTIONAL DRILLING APPARATUS

[75] Inventors: Tibor O. Edmond, Ponca City, Okla.; Rondon L. Schroeder, Wichita, Kans.; Clarence C. Smith, Ponca City, Okla.

[73] Assignee: Continental Oil Company, Ponca City, Okla.

[21] Appl. No.: 894,865

[22] Filed: Apr. 10, 1978

[51] Int. Cl.[2] ..... E21B 3/06

[52] U.S. Cl. ..... 175/27; 173/5; 173/145; 175/79

[58] Field of Search ..... 175/27, 73, 74, 75, 175/78, 79, 51, 61, 113; 173/5, 6, 7, 145

[56] References Cited

U.S. PATENT DOCUMENTS

| | | | |
|---|---|---|---|
| 1,925,012 | 8/1933 | Taylor | 173/6 |
| 2,118,650 | 5/1938 | Lee | 175/74 |
| 2,388,720 | 11/1945 | Wright | 175/51 X |
| 2,516,421 | 7/1950 | Robertson | 175/122 X |
| 2,539,047 | 1/1951 | Arutunoff | 175/78 X |
| 2,644,669 | 7/1953 | Curtis et al. | 175/78 X |
| 3,958,649 | 5/1976 | Bull et al. | 175/61 |
| 4,051,908 | 10/1977 | Driver | 175/78 |
| 4,062,412 | 12/1977 | McIlvanie | 175/78 X |

*Primary Examiner*—Ernest R. Purser
*Assistant Examiner*—Richard E. Favreau
*Attorney, Agent, or Firm*—Richard W. Collins

[57] ABSTRACT

A device for facilitating directional drilling of small diameter holes radially of a mine long hole comprising a segmented sleeve for movement through a guide channel in a main drill unit. A small bit is driven by a flexible shaft which passes through the segmented sleeve. The segmented sleeve remains partially in the guide channel and extends partially out of the guide channel in a straight line from the guide channel. The segments are joined in a manner permitting a 90° turn in the guide channel but allowing no curvature in the portion of the segmented sleeve extending from the guide channel.

3 Claims, 9 Drawing Figures

DIRECTIONAL DRILLING APPARATUS

BACKGROUND OF THE INVENTION

1.Field of the Invention

This invention relates to drilling of long generally horizontal holes in a coal seam ahead of mining of the coal to release methane gas from the coal seam. It is desirable to drill such long holes for substantial distances, such as several hundred meters, and the primary problem in such drilling is that of keeping the drill bit in the coal seam. A considerable amount of work has been done by the U.S. Bureau of Mines and private industry in developing techniques controlling the trajectory of long holes. Variables such as bit rotational speed, thrust and stabilizer placement affect the trajectory of a long hole, and directional survey tools are available to enable an operator to check the trajectory of a hole.

There are occasions when it is desirable for an operator to know where in the coal seam the long hole is relative to the roof or floor of the coal seam so that the variables controlling hole trajectory mentioned above can be adjusted to keep the bit in the coal seam.

The present invention provides an apparatus enabling an operator to determine the proximity of a long hole to the roof or floor of a coal seam at any point along the long hole.

2. Description of the Prior Art

A large number of prior art devices are available for drilling directional bores from an existing bore. Most of these devices are intended for directional drilling of oil wells. U.S. Pat. Nos. 2,743,082; 2,669,429 and 2,708,099 are representative of this type device.

Devices for drilling at right angles to a borehole utilizing flexible shafts in guide channels are illustrated in U.S. Pat. Nos. 1,595,922 and 4,051,908. U.S. Pat. No. 1,595,922 purports to provide a means for maintaining the direction of the deviated hole straight out from the primary bore.

SUMMARY OF THE INVENTION

According to the present invention, a device for facilitating directional drilling of small diameter holes radially of a mine long hole is provided. The device comprises a guide channel having a straight section and a curved section, and a segmented sleeve positioned within the guide channel. A flexible drill shaft passes through the segmented sleeve and rotates a drill bit extending out from the curved portion of the guide channel.

The segments forming the sleeve are joined together in a manner enabling the sleeve to slide through the curved portion of the guide channel, but allowing no slack in segments extending beyond the guide channel such that the drill bit is positively maintained in a straight line as it drills outwardly away from the guide channel.

DESCRIPTION OF THE PREFERRED EMBODIMENT

The preferred embodiment of the device in accordance with the invention, and the operation thereof, will now be described with reference to the drawings.

Figure 1:
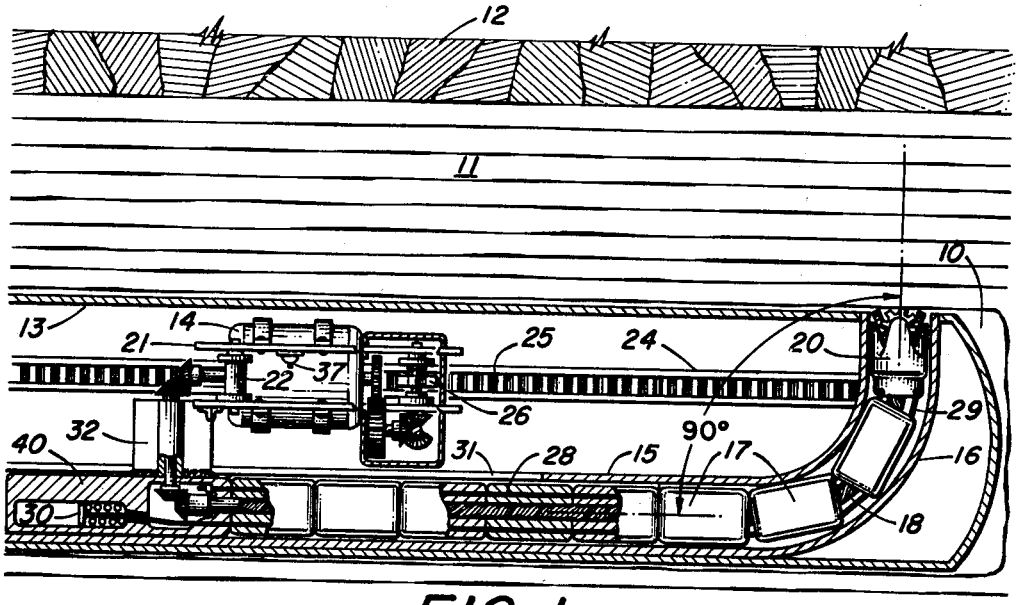
FIG. 1 is a side view, partially cut away, showing the device of the invention in its starting configuration in a mine long hole.
Figure 2:
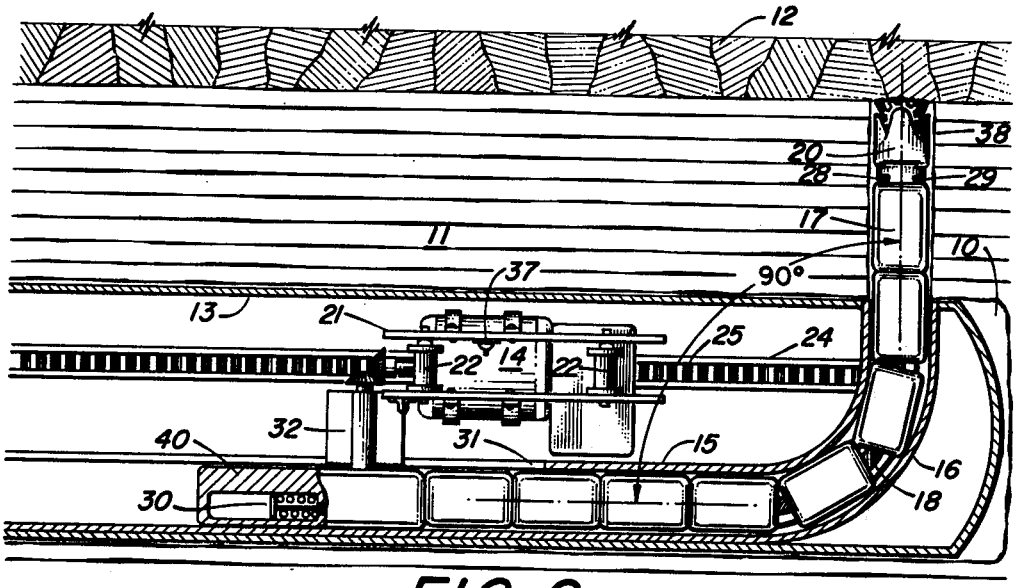
FIG. 2 is a view similar to FIG. 1 showing the device of the invention in operation.
Figure 3:
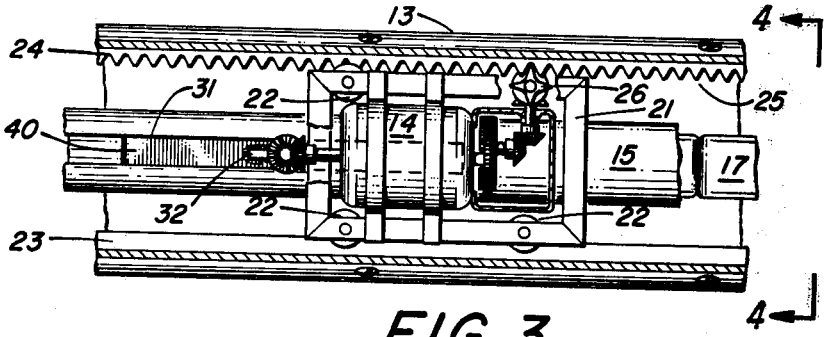
FIG. 3 is a plan view, partially cut away, illustrating the drill motor and tracking device of the invention.
Figure 4:
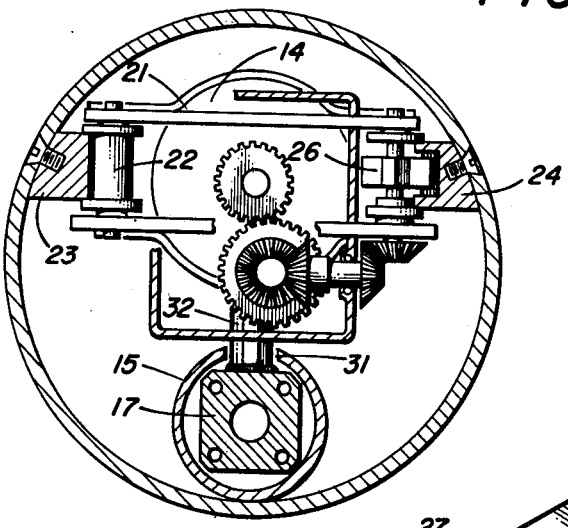
FIG. 4 is an end view showing the guide channel and segmented sleeve in enlarged cross section.

In FIGS. 1 and 2, a previously drilled long borehole 10 is shown extending through a coal formation 11 underlying a rock formation 12. An elongated tubular housing member 13 extending into borehole 10 houses a motor 14 and a guide channel having a straight section 15 and a curved section 16. A segmented sleeve comprised of sleeve segments 17 is slideably housed in the guide channel. A flexible drill shaft 18 extends through central openings 19 (FIG. 5) in sleeve segments 17, and is connected to a drill bit 20 at one end. The other end of flexible drill shaft 18 is connected by gearing to motor 14.

Motor 14 is supported (FIGS. 1, 2, 3 and 4) by brackets 21 and rollers 22 for movement along rail 23 and rack 24 which has a row of notched teeth 25. A cog wheel 26 engages the teeth 25 of rack 24 and is geared to motor 14 to move the motor and the segmented sleeve forward along rack 24.

Figure 5:
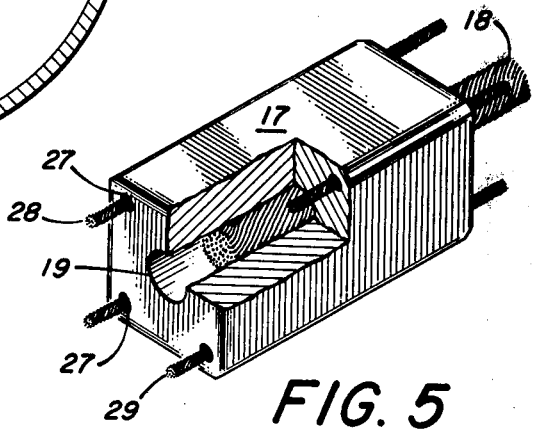
FIG. 5 is an isometric view, partially cut away, showing one of the sleeve segments and flexible cables extending therethrough.
Figure 6:
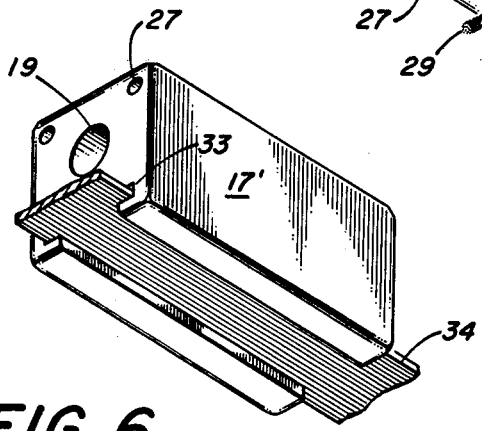
FIG.6 is an isometric view from below showing another embodiment of a sleeve segment.

Details of two embodiments of sleeve segments are shown in FIGS. 5 and 6 showing sleeve segments 17 and 17[1] respectively. In FIG. 5, a central opening 19 for housing flexible drill shaft 18 is shown in segment 17, and small openings 27 extending longitudinally through segment 17 are provided. Flexible cables 28 and 29, preferably of woven steel strands, extend through the holes 27 in segment 17. In FIG. 6, a channel 33 having a flexible metal strip 34 therein is substituted for the cables 29 of the version shown in FIG. 5.

As seen in FIGS. 1 and 2, upper flexible cables 28 extend through the top pair of holes 27 in sleeve segments 17 and are of a fixed length. Lower cables 29 extend through the lower holes in sleeve segments 17 from a rigid forward connection in drill bit 20 to a rear connection 30 in member 40 which provides just enough slack to enable the sleeve segments 17 to make the 90° bend through curved guide channel section 16 but which permits no slack between segments extending from curved guide channel 16 such that the borehole formed by the advancing drill bit is maintained in a straight line.

A slot 31 (FIG. 4) is formed in the top of straight guide channel section 15 to allow arm 32 extending from the support for motor 14 to rear member 40 to advance along the guide channel 15 as motor 14 operates. Motor 14 provides power to drill bit 20 and simultaneously advances along with the sleeve and drill bit as the unit operates.

Figure 8:
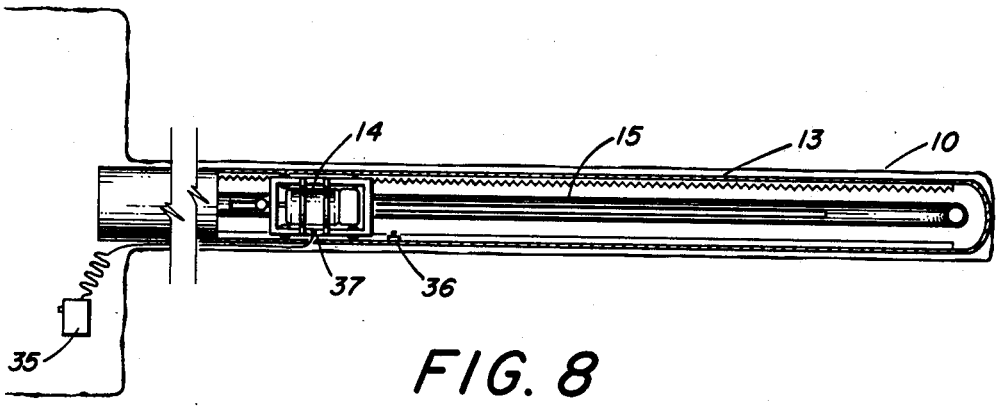
FIG. 8 is a cut away top plan view showing the relation of the device to a mine working area.
Figure 9:
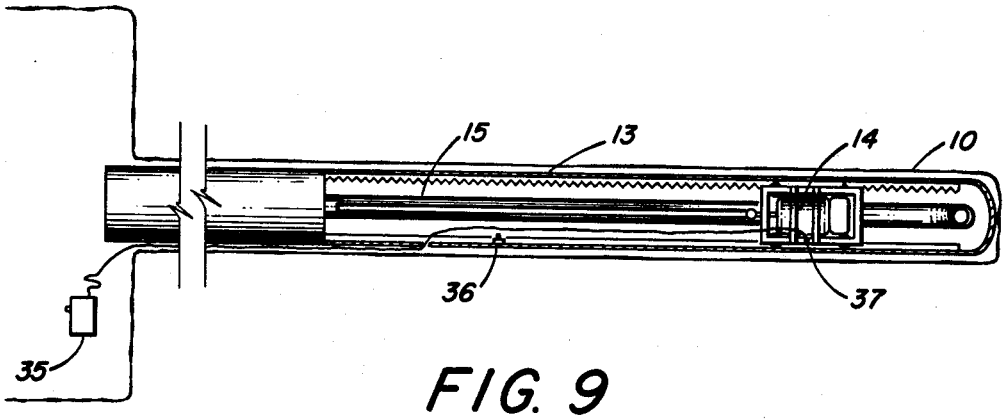
FIG. 9 is similar to FIG. 8 showing the motor in its extended position.
Figure 7:
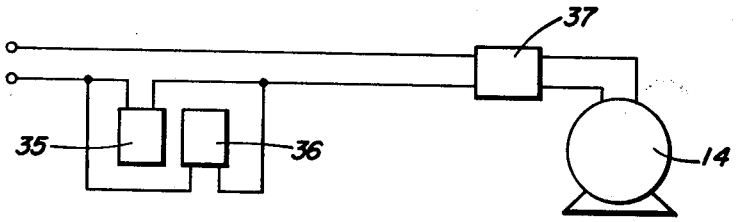
FIG. 7 is a schematic wiring diagram illustrating the control system for the device of the invention.

The wiring for controlling the operation of the device is illustrated schematically in FIG. 7. A normally open switch 35 located in a mine working area (FIGS. 8 and 9) where it can be closed by an operator is provided, and a contact switch 36 (FIG. 8) which is closed by initial movement of motor 14 along rack 24 is provided. Once contact switch 36 has been closed, switch 35 can be released until the unit has made a complete cycle. A torque actuated reversing switch 37 is provided for returning the unit to the starting position upon drill bit 20 encountering a hard formation, as will be explained in more detail later.

The operation of the device in accordance with the invention will now be described.

During drilling of long hole 10 in coal seam 11 underlying rock formation 12, it is desirable to know the distance from long hole 10 to the overlying rock formation 12. In order to determine this, the long hole drilling apparatus is withdrawn and the device of this invention is inserted in the long hole to a position near its farthest end. During insertion of the device, it will be in the configuration shown in FIGS. 1 and 8. Upon housing member 13 reaching the far extent of long hole 10, the unit is oriented such that drill bit 20 is aimed directly upward toward overlying rock formation 12. Normally open switch 35 is closed by an operator to initiate rotation of drill bit 20 and advancement of motor 14 and its associated elements. As motor 14 advances along rack 24 and rail 23, contact switch 36 (FIG. 8) is tripped to the closed position, and switch 35 can be released. As motor 14 advances toward the far end of housing 13, arm 32 drives sleeve segments 17 forward through guide channel 15 to force drill bit 20 out from the curved section 16 of the guide channel into the coal formation 11. Drill bit 20 advances outwardly from curved section 16 of the guide channel to form a small borehole 38 (FIG. 2). The controlled length of lower cables 29 extending through sleeve segments 17 assures that there is no slack between sleeve segments 17 which extend beyond housing 13, thus assuring that borehole 38 is a straight hole continuing upwardly from curved guide channel 16. Upon drill bit 20 reaching the position shown in FIG. 2, where it contacts the hard rock formation 12, the torque on motor 14 will increase to the point where reversing switch 37 is tripped and motor 14 will then move in the opposite direction drawing drill bit 20 back into the end of curved guide channel 16 to the position shown in FIG. 1. Upon reaching the starting position, contact switch 36 and reversing switch 37 are tripped by the motor frame, such that the motor is placed in the forward mode and the power to the motor is shut down. The unit is then ready for removal from the long hole or for drilling another small diameter hole from long hole 10 to rock formation 12. It is a relatively simple matter to determine how far the unit advanced during a cycle, thus enabling the operator to determine how far bit 20 advanced out of guide channel 16, thus indicating the distance between the top of long hole 10 and the overlying rock formation 12. It will be apparent that by rotating the entire unit 180°, the distance from the bottom of long hole 10 to an underlying rock formation could similarly be determined. In some cases it is desirable to drill a series of small holes radially of the long hole to provide information useful in continuing the long hole 10.

It will be apparent that numerous modifications and variations in the device as illustrated and described could be made within the true scope of the invention, which is defined by the appended claims.

We claim:

1. Apparatus for facilitating drilling of small diameter holes radially of a mine long hole comprising:

a housing member;

a guide channel member within said housing including a straight section and a curved section;

a sleeve device at least partially contained by said guide channel member and adapted to move longitudinally within said guide channel member, said sleeve device being formed of a plurality of sleeve segments in end-to-end relationship, said sleeve segments having longitudinal passages therethrough and being interconnected by connecting means permitting said sleeve device to move through said curved section of said guide channel member and restricting relative movement of any sleeve segments extending beyond the guide channel member whereby sleeve segments extending beyond the guide channel member define a straight path therefrom;

a flexible drill shaft extending through said longitudinal passages through said sleeve segments, said shaft being connected at one end to a drill bit; and motor means connected to the other end of said shaft for providing rotation thereto, said motor means also being adapted to move said drill shaft forwardly through said guide channel member.

2. Apparatus according to claim 1 including a rack mounted on the inside of said housing and a cog wheel connected to said motor and adapted to move said motor along said rack.

3. Apparatus according to claim 2 including a torque-actuated reversing switch controlling said motor for reversing the direction of said motor and returning said sleeve device to its starting position when the torque on the drill bit exceeds a predetermined value.

* * * * *